US007021090B1

(12) United States Patent
Nolle et al.

(10) Patent No.: US 7,021,090 B1
(45) Date of Patent: Apr. 4, 2006

(54) RINGLESS METER LOCK

(75) Inventors: Eric R. Nolle, South Wales, NY (US); Jeffrey R. Sullivan, Boston, NY (US)

(73) Assignee: McGard, LLC, Orchard Park, NY (US)

( * ) Notice: Subject to any disclaimer, the term of this patent is extended or adjusted under 35 U.S.C. 154(b) by 0 days.

(21) Appl. No.: 11/134,025

(22) Filed: May 20, 2005

(51) Int. Cl.
*E05B 65/48* (2006.01)

(52) U.S. Cl. ..... 70/2; 70/34; 70/56; 70/63; 70/159; 70/164; 70/451; 70/466; 292/281; 292/340

(58) Field of Classification Search ..... 70/2, 70/14, 63, 54–56, 158–173, 34, 386, 232, 70/6–13, 370, 371, 451, 466; 292/281, 282, 292/286, 340, DIG. 53; 248/551–553
See application file for complete search history.

(56) References Cited

U.S. PATENT DOCUMENTS 3,104,860 A * 9/1963 Brittain ..... 248/552
4,080,811 A * 3/1978 Nielsen, Jr. ..... 70/164
4,096,718 A * 6/1978 Michelman et al. ..... 70/63
4,107,959 A * 8/1978 Skarzynski et al. ..... 70/159
4,152,910 A * 5/1979 Swisher ..... 70/159
4,254,647 A * 3/1981 Finck, Jr. ..... 70/77
4,414,829 A * 11/1983 Nielsen et al. ..... 70/160
4,986,096 A * 1/1991 Soehner et al. ..... 70/54
5,315,849 A * 5/1994 Georgopoulos ..... 70/34
6,439,010 B1 * 8/2002 Julicher ..... 70/164
6,742,365 B1 * 6/2004 Sullivan et al. ..... 70/2
6,763,691 B1 * 7/2004 Rafferty ..... 70/164
6,931,893 B1 * 8/2005 Agbay ..... 70/2

OTHER PUBLICATIONS

"Jiffy Lock for Ringless Meter Locks",http:/www.inner-tite.com/jiffylock.html (at least as early as Nov. 18, 2001).*

* cited by examiner

*Primary Examiner*—Lloyd A. Gall
(74) *Attorney, Agent, or Firm*—Walter W. Duft

(57) ABSTRACT

A locking mechanism for securing the cover of a thin-walled box to the box frame. The locking mechanism includes a two-piece clip bracket having a stationary bracket member and a movable bracket member pivotally mounted to the stationary bracket member. The stationary bracket member is adapted to engage outside and inside surfaces of a wall of the box frame and remain stationary with respect thereto when the stationary bracket member is in an installation position. The movable bracket member is pivotable relative to the stationary bracket member into and out of engagement with the outside surface of the wall when the stationary bracket member is in the installation position. A lock body is adapted to latch to the movable bracket member and engage the cover. A spacer is mounted to the stationary bracket member and adapted to block movement of the movable bracket relative to the stationary bracket member when the movable bracket member is in engagement with the exterior surface of the wall. The spacer is situated so that it is trapped by the cover when the cover is closed and the spacer is blocking movement of the movable bracket member relative to the stationary bracket member.

20 Claims, 9 Drawing Sheets

RINGLESS METER LOCK

CROSS-REFERENCE TO RELATED APPLICATIONS

This application is commonly owned with U.S. patent application Ser. No. 10/299,986, filed Nov. 19, 2002, now U.S. Pat. No. 6,742,365, entitled "Ringless Meter Lock", and U.S. patent application Ser. No. 10/841,812, filed May 8, 2004, entitled "Ringless Meter Lock."

STATEMENT REGARDING FEDERALLY SPONSORED RESEARCH OR DEVELOPMENT

Not Applicable

BACKGROUND OF THE INVENTION

1. Field of the Invention

The present invention relates to a locking mechanism for securing the cover of a thin-walled box to a box frame. More particularly, the invention pertains to a lock for a ringless electrical meter box.

2. Description of the Prior Art

By way of background, utility companies provide and regulate power usage with the aide of metered fuse devices (meters). The meters allow power to run to individual customers and record the amount of power used by each customer. A typical electrical meter has rear electrical contact prongs that plug into electrical receptacles connected to a current transformer switch located inside a metal meter box that is situated individually or ganged with other meter boxes. In a ringless meter box, the meter is secured within the meter box by a hinged meter box cover having a flanged, circular opening through which the meter protrudes when the box cover is shut. The meter box prevents tampering with the meter and provides a means of disrupting or discontinuing service when necessary, whether for lack of payment by a customer or when service is no longer needed. This is done by removing the meter and covering the opening in the meter box cover, or by rotating the meter such that it does not contact the electrical receptacles, or by placing insulator plugs over the meter's electrical contact prongs. To prevent the reactivation of service by way of a replacement meter or a jumper placed across the meter box electrical receptacles, the meter box needs to be secured by tamper-proof means, such as a lock located on the exterior of the meter box, which prevents opening of the box cover. There are a number of different designs for meter box locks. Some require the use of tools to install while others are designed for hand installation without tools.

It is to improvements in the latter type of meter box lock design that the present invention is directed. In particular, what is needed is a hand-installable meter box lock that is easy to install and lock in place, minimizes the possibility of worker contact with electrical components, and provides robust security and anti-tampering features.

SUMMARY OF THE INVENTION

The foregoing problems are solved and an advance in the art is obtained by a novel locking mechanism for securing the cover of a thin-walled box to a box frame. The locking mechanism comprises a two-piece clip bracket having a stationary bracket member and a movable bracket member pivotally mounted to the stationary bracket member. The stationary bracket member is adapted to engage outside and inside surfaces of a wall of the box frame and remain stationary with respect thereto when the stationary bracket member is in an installation position. The movable bracket member is pivotable relative to the stationary bracket member into and out of engagement with the outside surface of the wall. A lock body is adapted to latch to the movable bracket member and engage the cover of the box frame. A spacer mounted to the stationary bracket member is adapted to block movement of the movable bracket member relative to the stationary bracket member when the movable bracket member is in engagement with the exterior surface of the wall. The spacer is situated so that it is trapped by the cover when the cover is closed, thereby providing a security feature of the locking mechanism.

In an exemplary embodiment of the invention, the stationary bracket member comprises an exterior flange portion adapted to engage the outside surface of the wall together with a top surface of the wall, an interior flange portion adapted to engage the inside surface of the wall, and an intermediate portion disposed between the exterior flange portion and the interior flange portion. The exterior flange portion and the interior flange portion of the stationary bracket member are preferably substantially parallel to each other. A wall engaging surface of the exterior flange portion and a wall engaging surface of the interior flange portion can also be positioned so that they accommodate a ledge in the wall of the box frame wherein the wall transitions outwardly away from an interior of the box at the ledge. The exterior flange portion of the stationary bracket member will engage the wall on a first side of the ledge and the interior flange portion of the stationary bracket member will engage the wall on a second side of the ledge. The exterior flange portion may comprise a first pair of spaced apart tabs and the interior flange portion may comprise a second pair of spaced apart tabs.

In a further aspect of the exemplary embodiment of the invention, the movable bracket member comprises an exterior flange portion adapted to engage the outside surface of the wall and an interior flange portion that is pivotally mounted to the intermediate portion of the stationary bracket member. The movable bracket member also comprises a lock body engaging flange extending from the exterior flange portion. The exterior flange portion of the movable bracket can be disposed between the spaced apart tabs on the exterior flange portion of the stationary bracket member. The interior flange portion of the movable bracket member may comprise a pair of apertured ears mounted to a pair of posts on the intermediate portion of the stationary bracket member.

In a still further aspect of the exemplary embodiment of the invention, the interior flange portion of the movable bracket member provides a first opposing surface for seating the spacer while the intermediate portion of the stationary bracket member includes an extension that provides a second opposing surface for seating the spacer. The spacer mounts to the stationary bracket member extension, which may include a pivot post to which the spacer is pivotally mounted. If desired, the stationary bracket member extension may include a pair of spaced apart pivot posts and the spacer may include a pair of corresponding slots adapted to removably mount to the pivot posts. In this way, the spacer can be selectively pivotally mounted to either one of the pivot posts.

The first and second opposing surfaces that receive the spacer can be substantially parallel to each other and the spacer may comprise a generally rectangular spacer block. Preferably, the first and second opposing surfaces are adapted to lie proximate to the cover when the cover is closed so that the spacer contacts the cover when the cover is closed and the spacer is seated between the opposing surfaces.

In the exemplary embodiment of the invention, the clip bracket and the lock body preferably comprise metal material and the spacer comprises plastic material. Other materials could also be used. An electrically insulative cover made of plastic or the like may be placed on the stationary bracket member to minimize the potential for electric shock in the event that the locking mechanism inadvertently touches electrical components during installation.

BRIEF DESCRIPTION OF THE DRAWINGS

The foregoing and other features and advantages of the invention will be apparent from the following more particular description of preferred embodiments of the invention, as illustrated in the accompanying Drawings, in which.

DETAILED DESCRIPTION OF THE PREFERRED EMBODIMENTS

Figure 1:
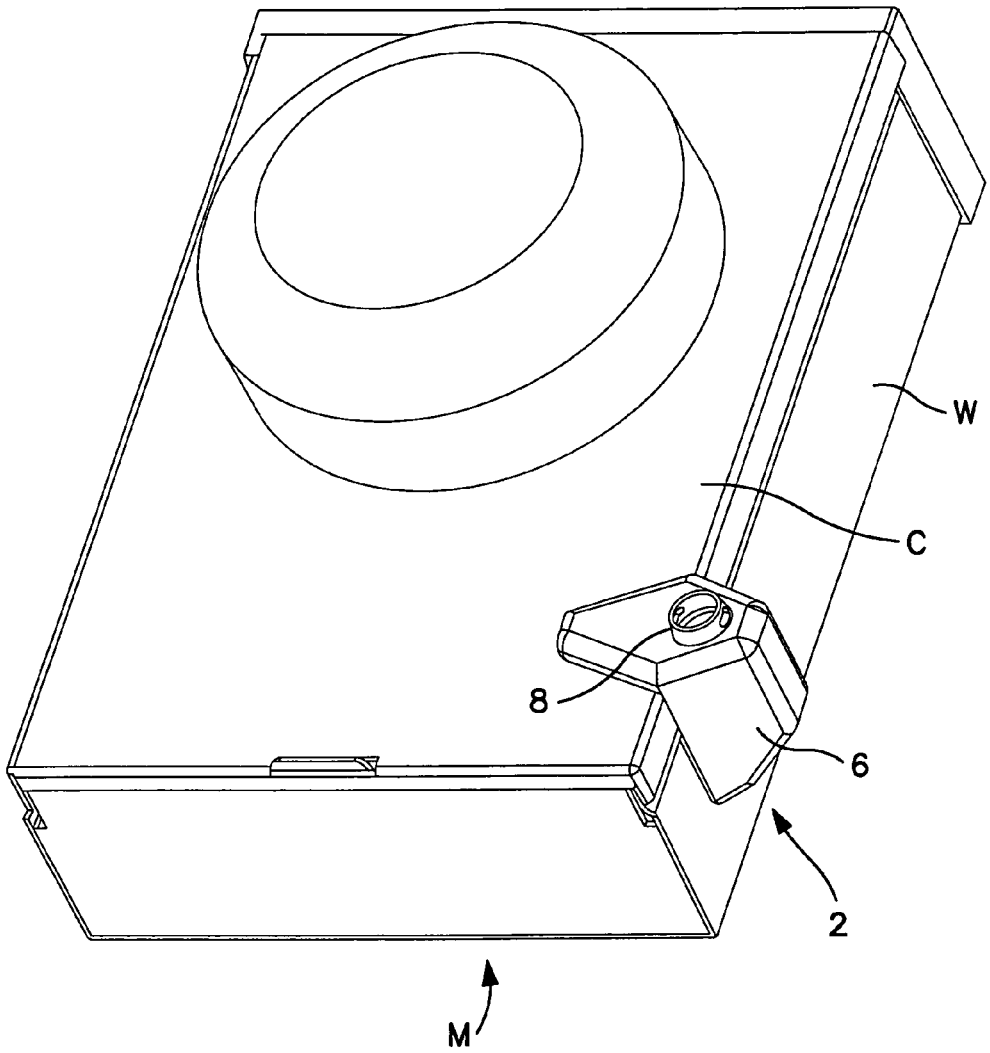
FIG. 1 is a perspective view showing a meter lock box secured by a locking mechanism constructed in accordance with the present invention.

Turning now to the drawings, wherein like reference numerals indicate like elements in all of the several views FIG. 1 illustrates a locking mechanism 2 for securing the cover C of an electrical meter lock box M in a closed position to prevent unauthorized access to the interior of the lock box. Other types of thin-walled boxes could also be used in conjunction with the locking mechanism 2, and the invention is thus not limited to a locking mechanism for electrical meter lock boxes only.

Figure 2:
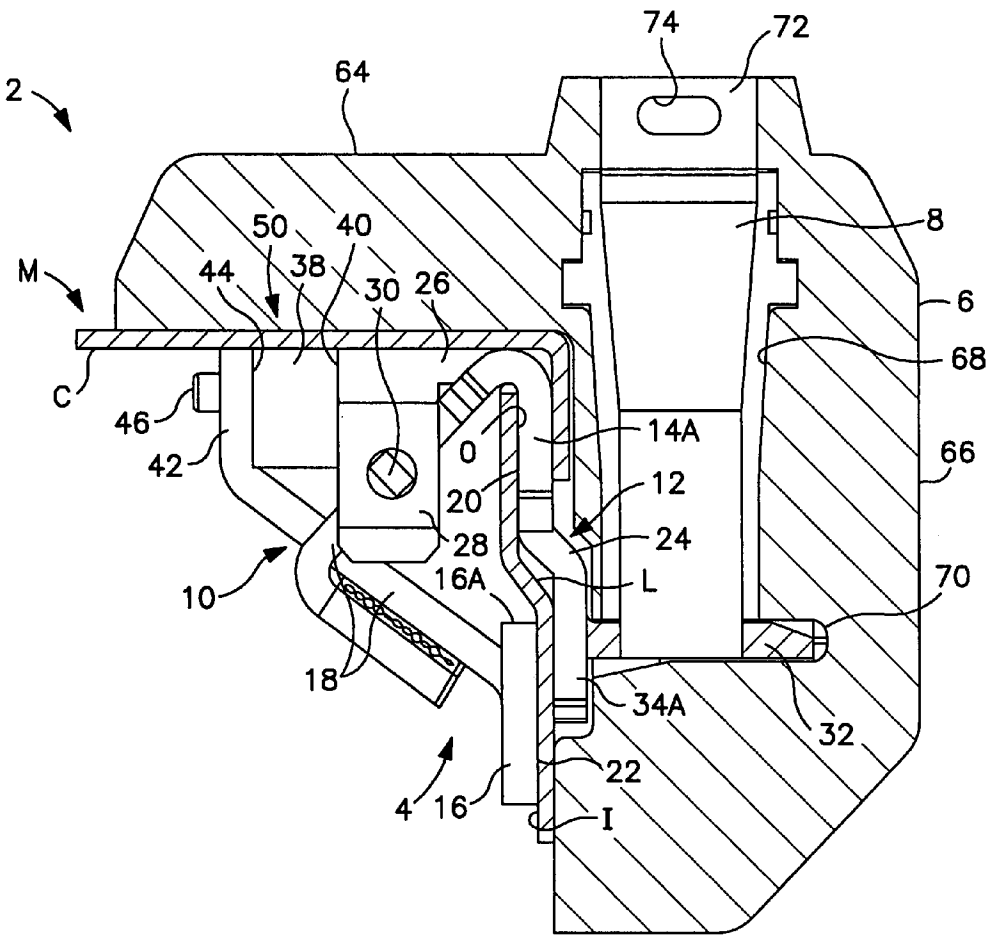
FIG. 2 is a side view showing the locking mechanism of FIG. 1 in a clamped position secured on the meter lock box of FIG. 1, with the box and a portion of the locking mechanism being illustrated in cross-section.
Figure 3:
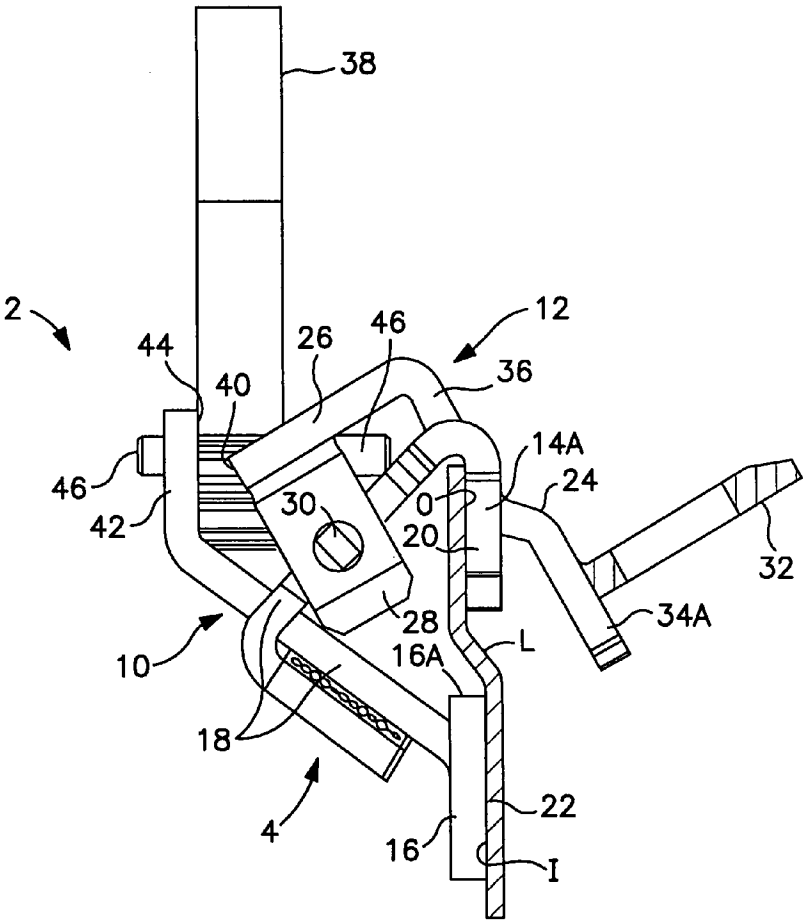
FIG. 3 is a side view showing the locking mechanism of FIG. 1 in an unclamped position.
Figure 4:
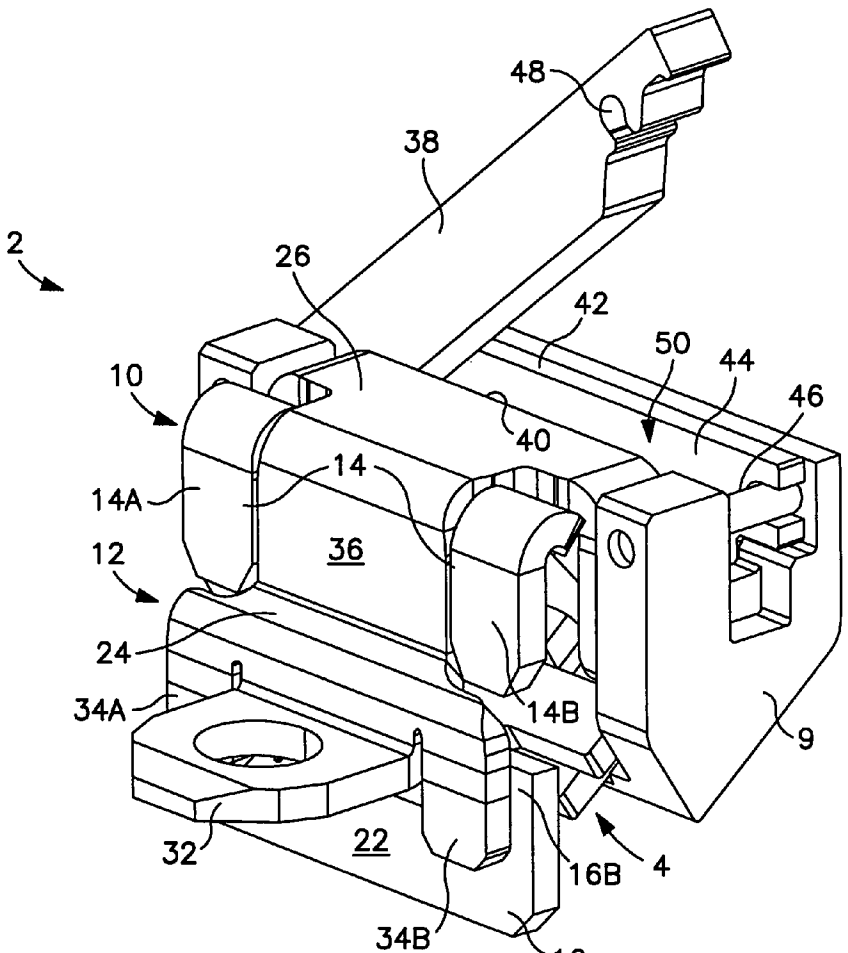
FIG. 4 is a perspective view showing the locking mechanism of FIG. 1 with a spacer thereof in a first exemplary pivot orientation.
Figure 5:
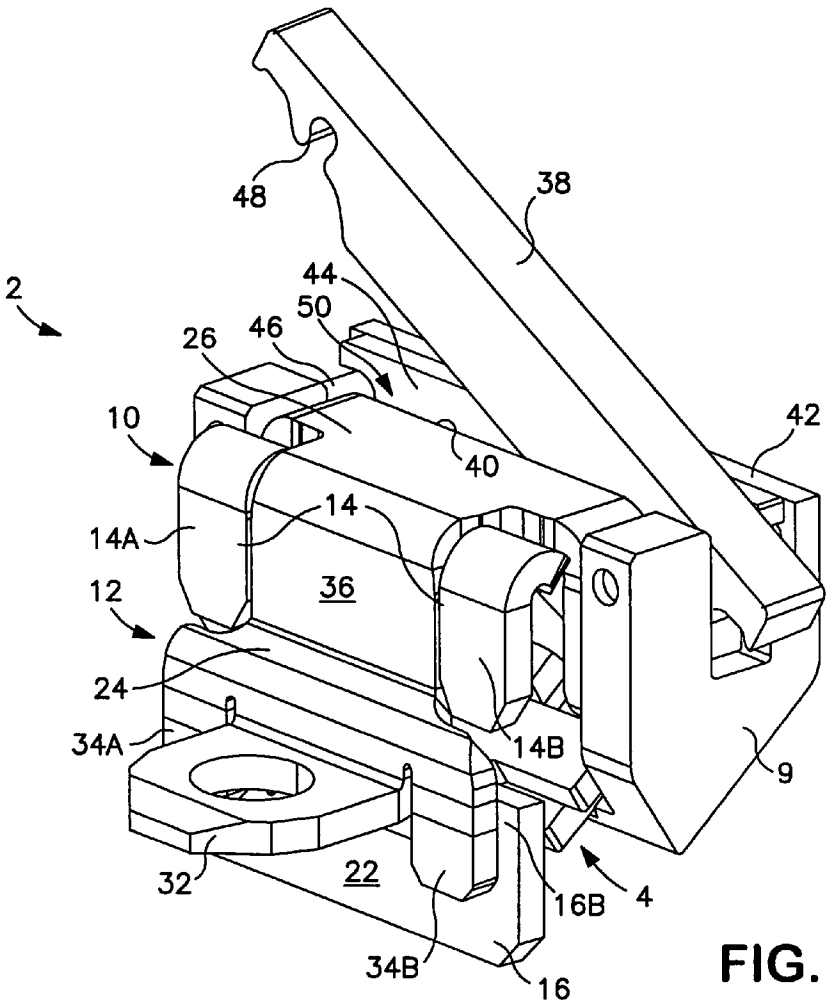
FIG. 5 is a perspective view showing the locking mechanism of FIG. 1 with a spacer thereof in a second exemplary pivot orientation.
Figure 6:
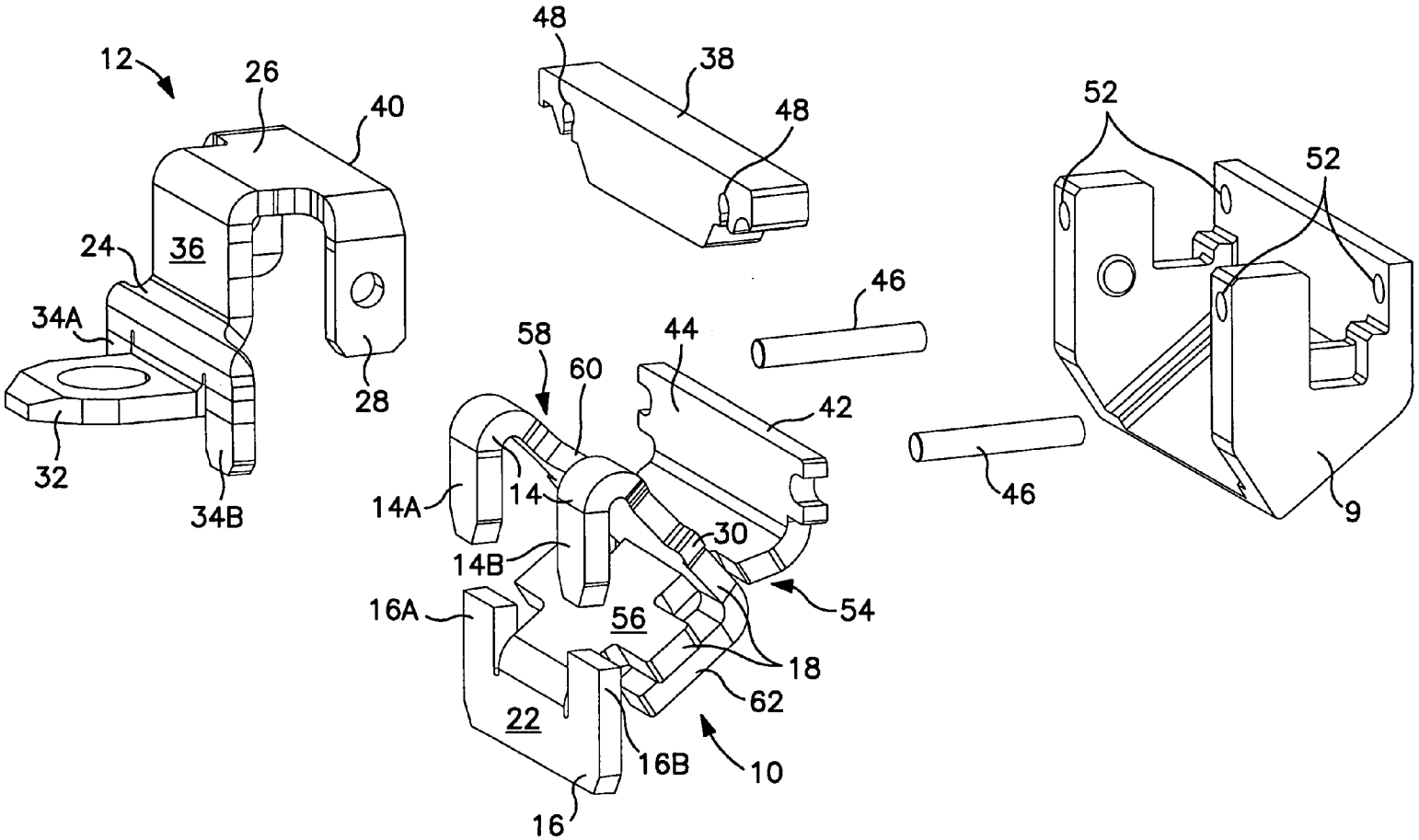
FIG. 6 is a an exploded perspective view showing individual components of the locking mechanism of FIG. 1.

As variously shown in FIGS. 2–6, the locking mechanism 2 includes a clip bracket 4, a protective outer lock body 6 with an internal plunger-style lock assembly 8, and an electrically insulative protective cover 9 (see FIGS. 4–6). The clip bracket 4 is adapted to engage a wall W of the meter box M whose cover C is to be secured. As shown in FIG. 2, the lock body 6 is adapted to latch to the clip bracket 4 and engage the box cover C, thereby securing the same.

The clip bracket 4 is a two-piece assembly that includes a stationary bracket member 10 and a movable bracket member 12 pivotally mounted to the stationary bracket member. As shown in FIGS. 2–3, the stationary bracket member 10 is adapted to engage respective outside and inside surfaces O and I of the wall W and remain stationary with respect thereto when the stationary bracket member is in an installation position. The stationary bracket member 10 comprises an exterior flange portion 14 formed by a first pair of spaced apart tabs 14A and 14B that are adapted to engage the outside surface O of the wall W together with a top surface of the wall. The stationary bracket member 10 further includes an interior flange portion 16 adapted to engage the inside surface I of the wall W. The interior flange portion 16 of the stationary bracket member 10 is formed with a second pair of spaced apart tabs 16A and 16B. An intermediate portion 18 of the stationary bracket member 10 extends between the exterior flange portion 14 and the interior flange portion 16. The exterior flange portion 14 and the interior flange portion 16 of the stationary bracket member 10 are preferably substantially parallel to each other. Moreover, a wall engaging surface 20 of the exterior flange portion 14 and a wall engaging surface 22 of the interior flange portion 16 are positioned so that they accommodate a ledge L in the wall W wherein the wall transitions outwardly away from an interior of the box M at the ledge. The exterior flange portion 14 engages the wall W on an upper side of the ledge and the interior flange portion 16 engages the wall on a lower side of the ledge. Advantageously, the tabs 16A and 16B extend upwardly toward the ledge L, and will be trapped by the ledge when the stationary bracket member 10 is in its installation position. This represents one of the security features of the locking mechanism 2.

As shown in FIG. 3, the movable bracket member 12 is pivotable relative to the stationary bracket member 10 into and out of engagement with the outside surface O of the wall W when the stationary bracket member is in its installation position. The movable bracket member 12 comprises an exterior flange portion 24 adapted to engage the outside surface O of the wall W and an interior flange portion 26 that is pivotally mounted to the intermediate portion 18 of the stationary bracket member 10. As can be seen in FIGS. 4–5, the exterior flange portion 24 of the movable bracket 12 is disposed between the spaced apart tabs 14A and 14 B on the exterior flange portion 14 of the stationary bracket member 10. As shown in FIGS. 2–3, the interior flange portion 26 of the movable bracket member 12 comprises a pair of apertured ears 28 mounted to a pair of posts 30 on the intermediate portion 18 of the stationary bracket member 10. The movable bracket member 12 also comprises a lock body engaging flange 32 extending from the exterior flange portion 24. The flange 32 is apertured and chamfered on its projecting end to facilitate latching engagement with the lock body 6. The aperture in the flange 32 is adapted to receive a plunger element of the locking mechanism 8, thereby effecting latching of the lock body 6 to the movable bracket member 12. The movable bracket member 12 is thus the portion of the bracket 4 to which the lock body 6 latches when engaging the cover C. A pair of spaced apart tabs 34A and 34B are formed on the exterior flange portion 24 of the movable bracket member 12, and extend downwardly below the flange 32. When the movable bracket member 12 is in its clamping position, the tabs 34A/B are adapted to engage the outside surface O of the wall W below the ledge L. A central upper region 36 of the exterior flange portion 24 also engages the outside surface O of the wall W above the ledge.

A spacer 38 is mounted to the stationary bracket member 10 and is adapted to block movement of the movable bracket member 12 relative to the stationary bracket member when the movable bracket member is in engagement with the outside surface O of the wall W. As best shown in FIG. 2, the spacer 38 is situated so that it is trapped by the cover C when the cover is closed and the spacer is blocking movement of the movable bracket member 12 relative to the stationary bracket member 10. The interior flange portion 26 of the movable bracket member provides a first opposing surface 40 for seating the spacer 38. The intermediate portion 18 of the stationary bracket member 10 includes an extension 42 that provides a second opposing surface 44 for seating the spacer 38.

In order to mount the spacer 38 to the stationary bracket member 10, the extension 42 mounts a pair of spaced apart pivot posts 46. The spacer 38 includes a pair of corresponding slots 48 adapted to removably mount to the pivot posts 46. The slots 48 are preferably configured in a manner that allows them to snap onto the pivot posts 46, so as to be detachably retained thereon. The spacer 38 can be selectively pivotally mounted to either one of the pivot posts 46 (see FIGS. 4 and 5), which facilitates mounting the locking mechanism 2 on either the right side or left side of the box M. In either position, the spacer 38 can be connected to whichever pivot post 46 is lower, so that gravity will tend to pivot the spacer 38 downwardly. This will maintain the spacer 38 out of the slot 50 defined by the opposing surfaces 40 and 44 during mounting of the locking mechanism 2, thereby allowing the movable bracket member 12 to be freely pivoted.

In the exemplary locking mechanism 2 shown in the figures, the opposing surfaces 40 and 44 of the slot 50 that receive the spacer 38 are substantially parallel to each other, and the spacer comprises a generally rectangular spacer block. Other shapes could also be used. Preferably, the opposing surfaces 40 and 44 are positioned to lie proximate to the cover C when the cover is closed so that the spacer 38 contacts the cover when the cover is closed and the spacer is seated in the slot 50. This will facilitate the above-mentioned trapping of the spacer 38 by the cover C.

The electrically insulative cover 9 is an optional component that is mounted on the stationary bracket member 10. Its purpose is to minimize the potential for electric shock in the event that the locking mechanism 2 inadvertently touches electrical components during installation. As shown in FIG. 6, the cover 9 may be provided with two pairs of apertures 52 that receive the pivot posts 46 and thus help support these elements. The cover 9 can be mounted to the stationary bracket member 10 using any suitable mechanical fastening arrangement.

As best shown in FIG. 6, the stationary bracket member 10 may be constructed as a two piece body made from a suitable metal, such as steel or the like. A first body piece 54 includes the interior flange portion 16, the bracket member extension 42, and a central portion 56. A second body piece 58 includes the exterior flange portion 14, a central portion 60 that provides the posts 30, and a base portion 62 that is welded or otherwise attached to the central portion 56 of the first body piece 54. A conventional casting or forging method may also be used to form the stationary bracket member 10. The movable bracket member 12 can be formed from a single piece of a suitable metal, such as steel or the like, that is patterned and formed into the desired shape. A conventional casting or forging method may also be used to form the movable bracket member 12. The cover 9 and the spacer 38 can both be formed from molded plastic using a conventional molding method.

Returning now to FIGS. 1–2, the lock body 6 can be constructed in accordance with the lock body design of commonly owned U.S. Pat. No. 6,742,365, the disclosure of which is hereby incorporated herein by this reference. The lock body 6 may thus be fabricated as a singular block made from any suitable material capable of withstanding tampering (e.g. hammering, sawing and prying), such as heat-treated or hardened steel or the like. Advantageously, the lock body 6 may be configured to restrict gripping and hammering by having angled and radiused surfaces that eliminate purchase points. In particular, the surfaces of the lock body 6 can be configured such that no two surfaces are mutually parallel, so that there are no exposed ninety-degree surface intersections, and so that all potential purchase points, especially those at the top of the lock body 6, are rounded. The lock body 6 is configured to define a lock tab portion 64 that is adapted to engage the box cover C, and main body portion 66. The lock tab portion 64 and the main body portion 66 intersect at an angle of approximately 90 degrees to form a cut out region that conforms to the exterior contour of the box M (see FIG. 2). The lock tab portion 64 will thus engage the top of the box cover C during use, while the main body portion 66 will be oriented in adjacent facing relationship with the wall W. The main body portion 66 has a longitudinally extending opening 68 and a laterally extending opening 70 that is generally slot shaped to receive the flange 32 on the movable bracket member 12. The main body portion 66 of the lock body 6 also has a protruding seal holder 72 coaxially formed around the longitudinal opening 68. The seal holder 72 is constructed with one or more openings 74 adapted to receive a wire-like seal for identifying a service provider. The longitudinal opening 68 of the lock body 6 is designed to receive the plunger-style lock assembly 8 that secures the lock body 6 to the movable bracket member 12. The lock assembly 8 may be of any suitable type, such as a barrel lock adapted for no-slam installation (not shown), or a key and tumbler lock allowing for slam or no-slam installation (not shown).

Figure 7:
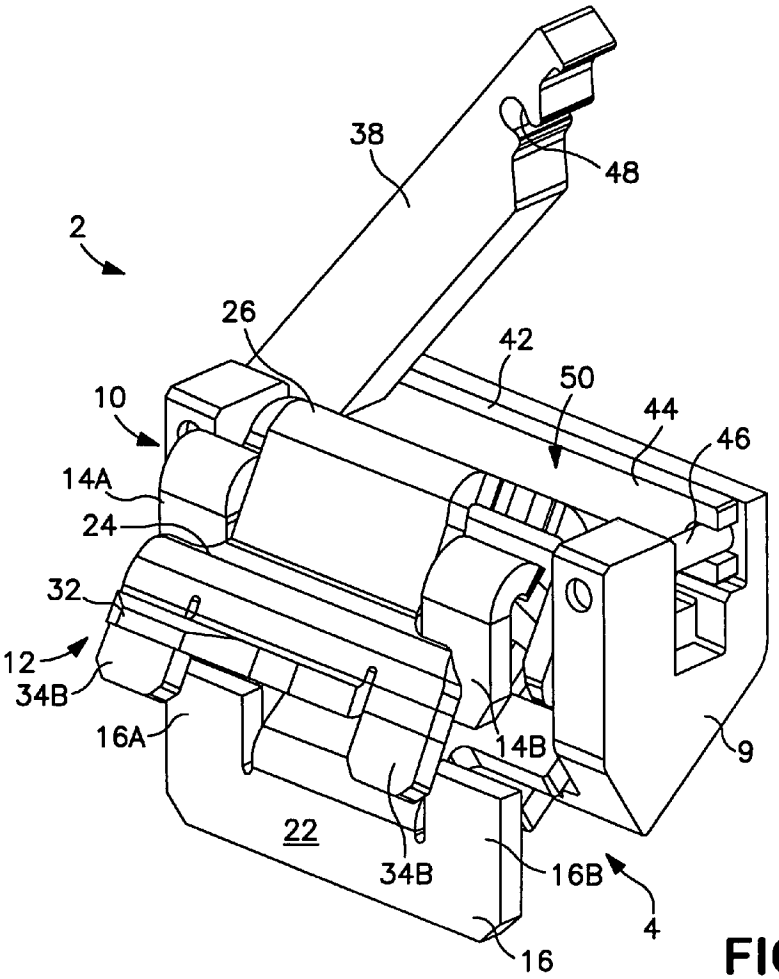
FIG. 7 is a perspective view showing the locking mechanism of FIG. 11 in an unclamped position.
Figure 7A:
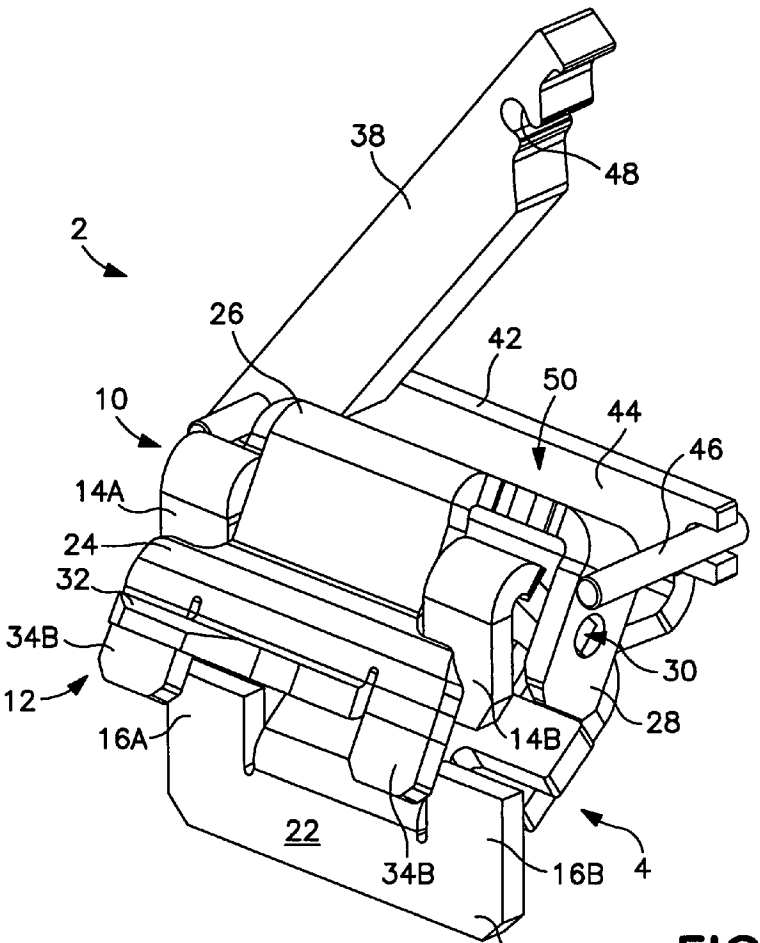
FIG. 7A is a perspective view showing the locking mechanism of FIG. 1 in an unclamped position with an insulative cover thereof removed to illustrate the pivot action.
Figure 8:
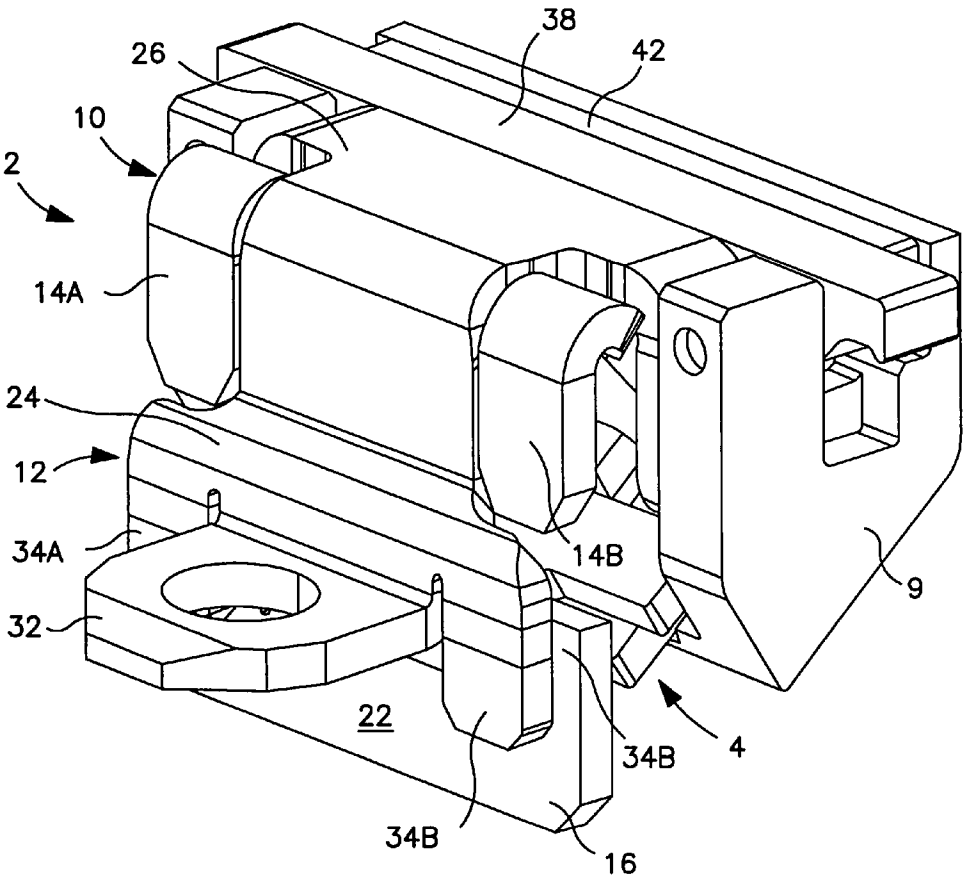
FIG. 8 is a perspective view showing the locking mechanism of FIG. 1 in a clamping position.

The operation of the locking mechanism 2 will now be described in detail with reference to FIGS. 7–8. The locking mechanism 2 can be secured on the box M in two quick steps, without the use of a key. First, the clip bracket 4 is manipulated into the open unclamped position of FIG. 7 by maneuvering the spacer 38 out of its slot 50 and pivoting the movable bracket member 12 relative to the stationary bracket member 10. This spacer 38 can be manipulated by detaching one of the slots 48 out of engagement with one of the pivot posts 46, then pivoting the spacer via the pivotal connection between the remaining slot 48 and pivot post 46. Alternatively, the spacer 38 could be completely detached from both pivot posts 46. Once the spacer 38 is out of the slot 50 and no longer blocking the movable bracket member 12, the latter can be pivoted relative to the stationary bracket member 10 into the unclamped position. FIG. 7A shows this pivoting action with the insulative cover 9 removed. With the movable bracket member 12 in the unclamped position of FIG. 7, the clip bracket 4 is mounted on the wall W so that the exterior flange portion 14 of the stationary bracket member 10 engages the outside surface O of the wall W and the interior flange portion 16 engages the wall's inside surface I. FIG. 3 illustrates the clip bracket 4 in this position. The movable bracket member 12 is now pivoted to its clamping position in which the exterior flange portion 24 engages the outside surface O of the wall W. The spacer 38 can then be maneuvered into the slot 50 to block the movable bracket member 12 and prevent it from unclamping. The spacer 38 is secured in place by ensuring that the slots 48 are snapped into position on the pivot posts 46. FIG. 8 illustrates the clip bracket 4 in this position.

Note that this operation does not require closure of the box cover C. Moreover, once the movable bracket member 12 is in its clamping position and blocked against unclamping by the spacer 38, the clip bracket 4 will remain on the wall W. Thus, the locking mechanism 2 can be easily installed on the box M and will be retained in position during closure of the box cover C, even when the box is mounted in the standard vertical orientation. This represents a "zero gravity" installation capability in which the clip bracket 4 does not need to be held while the cover C is being closed.

At this point, the box cover C can be closed. As shown in FIG. 2, the spacer 38 will be trapped in the slot 50 by the box cover C. This will all but eliminate the possibility of the spacer 38 being pivoted out of engagement with the slot 50 should an attempt be made to dislodge the locking mechanism 2 by unauthorized means. As mentioned above, FIG. 2 also shows that the tabs 16A and 16B of the stationary bracket member 10 will be captured beneath the ledge L in the box wall W. This will further help prevent the locking mechanism 2 from being improperly removed.

Following closure of the cover C, the lock body 6 is positioned so that the lateral opening 70 is aligned with the flange 32 on the movable bracket member 12. The main body portion 66 of the lock body 6 is then advanced toward the meter box M until the flange 32 is fully received in the lateral opening 70. The lock assembly 8 will then be positioned for latching to the movable bracket member 12 by way of the lock assembly's plunger engaging the aperture in the flange 32. This will secure the lock body 6 to the clip bracket 4 and further secure the cover C of the box M as a result of the lock tab portion 64 of the lock body 6 substantially engaging the box cover C and the main body portion 66 of the lock body being fixed against movement relative to the wall W.

Accordingly, an improved ringless meter lock for securing the cover of a thin-walled box to a box frame has been disclosed. While an exemplary embodiment of the invention has been shown and described, it should be apparent that many variations and alternative embodiments could be implemented in accordance with the teachings herein. It is understood, therefore, that the invention is not to be in any way limited except in accordance with the spirit of the appended claims and their equivalents.

What is claimed is:

1. A locking mechanism for securing the cover of a thin-walled box to a box frame comprising:

a two-piece clip bracket having a stationary bracket member and a movable bracket member pivotally mounted to said stationary bracket member;

said stationary bracket member being adapted to engage outside and inside surfaces of a wall of said box frame and remain stationary with respect thereto when said stationary bracket member is in an installation position;

said movable bracket member being pivotable relative to said stationary bracket member into and out of engagement with said outside surface of said wall when said stationary bracket member is in said installation position;

a lock body adapted to latch to said movable bracket member and engage said cover;

a spacer mounted to said stationary bracket member and adapted to block movement of said movable bracket member relative to said stationary bracket member when said movable bracket member is in engagement with said outside surface of said wall; and said spacer being situated so that it is trapped by said cover when said cover is closed and said spacer is blocking movement of said movable bracket member relative to said stationary bracket member.

2. A locking mechanism in accordance with claim 1 wherein said stationary bracket member comprises an exterior flange portion adapted to engage said outside surface of said wall together with a top surface of said wall, an interior flange portion adapted to engage said inside surface of said wall, and an intermediate portion disposed between said exterior flange portion and said interior flange portion.

3. A locking mechanism in accordance with claim 2 wherein said exterior flange portion and said interior flange portion of said stationary bracket member are substantially parallel to each other.

4. A locking mechanism in accordance with claim 3 wherein a wall engaging surface of said exterior flange portion of said stationary bracket member and a wall engaging surface of said interior flange portion of said stationary bracket member are positioned to accommodate a ledge in said wall of said box frame wherein said wall transitions outwardly away from an interior of said box at said ledge and said exterior flange portion of said stationary bracket member engages said wall on a first side of said ledge and said interior flange portion of said stationary bracket member engages said wall on a second side of said ledge.

5. A locking mechanism in accordance with claim 2 wherein said exterior flange portion of said stationary member comprises a first pair of spaced apart tabs and said interior flange portion of said stationary member comprises a second pair of spaced apart tabs.

6. A locking mechanism in accordance with claim 2 wherein said movable bracket member comprises an exterior flange portion adapted to engage said outside surface of said wall and an interior flange portion pivotally mounted to said intermediate portion of said stationary bracket member.

7. A locking mechanism in accordance with claim 6 wherein said movable bracket member comprises a lock body engaging flange extending from said exterior flange portion of said movable bracket.

8. A locking mechanism in accordance with claim 7 wherein said exterior flange portion of said movable bracket is disposed between spaced apart tabs on said exterior flange portion of said stationary bracket member.

9. A locking mechanism in accordance with claim 6 wherein said interior flange portion of said movable bracket member comprises a pair of apertured ears mounted to a pair of posts on said intermediate portion of said stationary bracket member.

10. A locking mechanism in accordance with claim 6 wherein said interior flange portion of said movable bracket member provides a first opposing surface for seating said spacer.

11. A locking mechanism in accordance with claim 10 wherein said intermediate portion of said stationary bracket member includes an extension that provides a second opposing surface for seating said spacer.

12. A locking mechanism in accordance with claim 11 wherein said spacer mounts to said stationary bracket member extension.

13. A locking mechanism in accordance with claim 12 wherein said stationary bracket member extension includes a pivot post to which said spacer is pivotally mounted.

14. A locking mechanism in accordance with claim 13 wherein said stationary bracket member extension includes a pair of spaced apart pivot posts and said spacer includes a pair of corresponding slots adapted to removably mount to said pivot posts, whereby said spacer can be selectively pivotally mounted to either one of said pivot posts.

15. A locking mechanism in accordance with claim 14 wherein said first and second opposing surfaces are substantially parallel to each other and said spacer comprises a generally rectangular spacer block.

16. A locking mechanism in accordance with claim 15 wherein said first and second opposing surfaces are adapted to lie proximate to said cover when said cover is closed so that said spacer contacts said cover when said cover is closed and said spacer is seated between said opposing surfaces.

17. A locking mechanism in accordance with claim 1 wherein said clip bracket and said lock body comprise metal material and said spacer comprises plastic material.

18. A locking mechanism in accordance with claim 1 further including an electrically insulative cover on said stationary bracket member.

19. A method for securing the cover of a thin-walled box to a box frame, comprising:

placing a two-piece clip bracket on a wall of said box frame, said clip bracket having a stationary bracket member and a movable bracket member pivotally mounted to said stationary bracket member;

said stationary bracket member being adapted to engage outside and inside surfaces of said wall of said box frame and remain stationary with respect thereto when said stationary bracket member is in an installation position;

said movable bracket member being pivotable relative to said stationary bracket member into and out of engagement with said outside surface of said wall when said stationary bracket member is in said installation position;

said stationary bracket member having a spacer mounted thereto that is adapted to block movement of said movable bracket member relative to said stationary bracket member when said movable bracket member is in engagement with said outside surface of said wall;

said spacer being trapped by said cover when said cover is closed and said spacer is positioned to block movement of said movable bracket member relative to said stationary bracket member;

pivoting said movable bracket member into engagement with said outside surface of said wall;

placing said spacer in a blocking position to block movement of said movable bracket member relative to said stationary bracket member;

closing said cover; and securing said cover by placing a lock body on said movable bracket member so that said lock body latches to said movable bracket member and engages said cover.

20. A locking mechanism for securing the cover of a thin-walled box to a box frame comprising:

a two-piece clip bracket having a stationary bracket member and a movable bracket member pivotally mounted to said stationary bracket member;

said stationary bracket member comprising means for engaging outside and inside surfaces of a wall of said box frame and remaining stationary with respect thereto when said stationary bracket member is in an installation position;

said movable bracket member being pivotable relative to said stationary bracket member into and out of engagement with said outside surface of said wall when said stationary bracket member is in said installation position;

a lock body adapted to latch to said movable bracket member and engage said cover;

spacer means for blocking movement of said movable bracket member relative to said stationary bracket member when said movable bracket member is in engagement with said outside surface of said wall; and said spacer means being situated so as to be trapped by said cover when said cover is closed and said spacer means is blocking movement of said movable bracket member relative to said stationary bracket member.

* * * * *